United States Patent [19]

Czauderna

[11] Patent Number: 4,676,079

[45] Date of Patent: Jun. 30, 1987

[54] APPLIANCE FOR DRAINING WASHED LAUNDRY ARTICLES

[75] Inventor: Klaus Czauderna, Hiddenhausen, Fed. Rep. of Germany

[73] Assignee: Herbert Kannegiesser GmbH & co., Vlotho, Fed. Rep. of Germany

[21] Appl. No.: 694,194

[22] Filed: Jan. 23, 1985

Related U.S. Application Data

[63] Continuation-in-part of Ser. No. 662,741, Oct. 19, 1984, abandoned.

[51] Int. Cl.[4] ..... D06F 47/06

[52] U.S. Cl. ..... 68/242; 100/90; 100/116; 100/211

[58] Field of Search ..... 68/19.1, 21, 241, 242; 100/90, 116, 125, 211

[56] References Cited

U.S. PATENT DOCUMENTS

| | | | |
|---|---|---|---|
| 2,109,559 | 3/1938 | Wickert, Jr. | 100/116 X |
| 4,471,637 | 9/1984 | Holzinger | 68/241 |

FOREIGN PATENT DOCUMENTS

| | | | |
|---|---|---|---|
| 3307229 | 9/1984 | Fed. Rep. of Germany | 68/242 |
| 539106 | 12/1976 | U.S.S.R. | 68/242 |
| 874804 | 10/1981 | U.S.S.R. | 68/242 |

*Primary Examiner*—Philip R. Coe

*Attorney, Agent, or Firm*—Sughrue, Mion, Zinn, Macpeak, and Seas

[57] ABSTRACT

During the drainage of washed laundry articles in a drainage press, there is, in addition to the discharge of water in the lower region via a lower counterpressure plate (12), the discharge of water through a plunger plate (15) of a pressure plunger (14) via a perforated stamp plate using air pressure for more effective drainage with careful treatment of the laundry articles.

15 Claims, 6 Drawing Figures

APPLIANCE FOR DRAINING WASHED LAUNDRY ARTICLES

CROSS REFERENCE TO RELATED APPLICATIONS

This application is a continuation-in-part of application Ser. No. 662,741, filed Oct. 19, 1984, and now abandoned.

DESCRIPTION

FIELD OF THE INVENTION

The invention relates to a process for draining washed laundry articles, in which the laundry articles are subjected to mechanical pressure (mechanical drainage) in a (cylindrical) vessel, in such a way that water escapes from the vessel via a bottom base permeable to water (counterpressure plate). The invention also relates to an appliance intended especially for carrying out the processw.

BACKGROUND OF THE INVENTION

In a known drainage press of the above-mentioned type (DE-A No. 3,228,512), the base of the cylindrical vessel is designed as a counterpressure plate and is provided with a plurality of transversely directed channels for discharging the water pressed out of the laundry articles. The necessary pressing force is generated by a pressure plunger, the plunger plate of which can be lowered into the vessel from above. The plunger plate presses the laundry articles against the bottom counterpressure plate, so that the water pressed out can escape in the region of the latter.

The drainage press according to DE-A No. 3,228,512 is provide dnot only with mechanical drainage, but also with devices for flow drainage. During one phase of the drainage, compressed air is introduced into the vessel via the pressure plunger or the plunger plate and is conveyed through the laundry articles.

The object on which the invention is based is to improve the drainage press mentioned in the introduction, in such a way that, whilst ensuring careful treatment of the laundry articles, the drainage capacity is increased.

SUMMARY OF THE INVENTION

To achieve this object, the process according to the invention is defined in that water is (also) discharged from the vessel in the upper region of the latter as a result of the mechanical pressure.

According to the invention, therefore, water is discharged not only in the lower region of the vessel via the base or the counterpressure plate, but also in the upper region of the vessel, specifically, in particular, vai the pressure plunger or its plunger plate. As a result of this double-sided drainage, the capacity of the drainage press, especially during the initial phase of mechanical drainage is increased considerably. Approximately 40% of the water extracted from the laundry is discharged in the upper region of the vessel, that is to say via the plunger plate. The residual moisture remaining in the laundry articles (laundry cake) after drainage has ended is clearly reduced in comparison with known processes. Furthermore, an improvement, particularly a careful treatment of the laundry articles, is achieved because, as a result of the drainage on both sides, the build-up of pressure during mechanical drainage (in the laundry cake) takes place more slowly than during drainage in a downward direction only (under conditions which are the same as regards the pressure-plunger descent speed, etc.), and also because air inclusions occurring when the laundry articles are flushed into the vessel can likewise escape upwards and downwards, together with the water.

According to a further proposal of the invention, the drainage in the upper region of the vessel is effective only during a part phase of the total drainage operation, especially only during an initial phase. After this initial phase, the discharge of water in the upper region of the vessel is switched off and drainage continues only via the lower counterpessur plate.

The appliance accoding to the invention preferably corresponds substantially to that according to DE-A No. 3,228,512, flow drainage admittedly being advantageous, but not absolutely necessary. As a result of the doublesided mechanical drainage according to the invention, good results as regards the residual moisture can be achieved even without additional flow drainage.

The appliance accordingly consists, in particular, of a (liftable and lowerable) cylindrical vessel with a water-discharging lower counterpressure plate, and of a pressure plunger which can be moved up and down and which has a plunger plate acting on the laundry articles within the vessel. According to the invention, water throughflow orifices leading upwards or outwards are formed in this plunger plate, preferably in the shape of continuous vertical pipe connectors. These convey the water, in the region of the upper drainage, to an at least partially elastic outlet line.

In a particularly advantageous exemplary embodiment, several pipe connectors of the plunger plate open into a common collecting line, especially an annular channel, on the topside of the plunger plate. This collecting line is connected, in turn, to the (elastic) outlet line (hose) via a connection piece.

The discharge of water via the pipe connectors or the annular channel can be prevented centrally, specifically, in particular, controlled as a function of time. For this purpose, a controllable shut-off valve is located in the outlet line or in the connection piece to this. Furthermore, the individual pipe-connectors are provided with non-return valves which prevent flowing media (water, air) from returning into the vessel from outside.

In drainage presses with flow drainage, that is to say in the design according to DE-A No. 3,228,512, compressed air is introduced centrally into the vessel via a piston rod of the plunger plate. According to the invention, the compressed air is now introduced, starting with the final phase of activity of the upper drainage. The result of this is that water located in the upper drainage system (channels, pipe connectors) is forced out of this. Consequently, flow drainage and mechanical drainage via the upper drainage system take place with an overlap in time. This is upto 10 seconds, especially 5 second.

According to a further feature of the invention, the underside of the pressure plunger or of the plunger plate is provided with an elastic covering or with an elastic pressure cushion. This is preferably designed as a slab-shaped body made of elastic plastic foam. Highly compressed polyurethane foam with a weight per unit volume of 700 to 800 kg/m$^3$ is particularly suitable for this. A plurality of bores with a diameter of approximately 5 to 10 mm, especially 6 mm, is arranged in the elastic pressure cushion. The bores lead up to the underside of the plunger plate which is provided with channels for air and water guidance.

Alternatively, the pressure cushion can advantageously be designed as a hollow body which is filled with a liquid or a gas and which is limited at the top by the plunger plate. In this design of the pressure cushion, (elastic) hose pieces are guided through the filled hollow body from the plunger plate to the underside, to make it possible, on the one hand, for water to pass through from the interior of the vessel via the pressure plunger and, on the other hand, to introduce compressed air into the vessel to carry out flow drainage. The medium within the hollow body can be under pressure, so that the elastic walls of the latter (diaphragm) are held under prestress.

BRIEF DESCRIPTION OF THE DRAWINGS

Exemplary embodiments of the invention are explained in more detail below with reference to the drawings. In the drawings.

DESCRIPTION OF THE PREFERRED EMBODIMENTS

Figure 1:
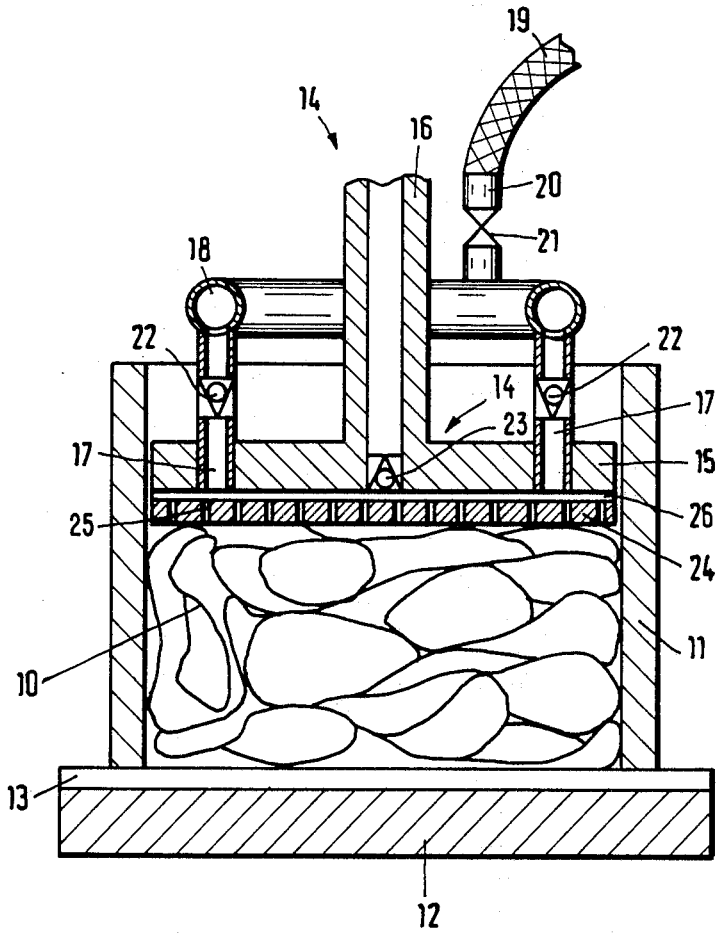
FIG. 1 shows a diagrammatic vertical section through a drainage press.

The invention can advantageously be used in conjunction with a drainage press corresponding to that according to DE-A No. 3,228,512.

Laundry articles 10 are accordingly received in a cylindrical vessel 11. This rests on a lower counter-pressure plate 12 so as to be moveable up and down. For the discharge of water in the lower region of the vessel 11, the counterpressure plate 12 is provided with water discharge grooves 13 on its topside.

For mechanical drainage, the laundry articles 10 in the vessel 11 are subjected to a pressure plunger 14, the plunger plate 15 of which can be introduced into the open vessel 11 from above and can be lowered in the latter.

The plunger plate 15, which approximately fills the inner cross-section of the vessel 11, is pressed against the laundry articles 10 by means of a pressure-medium cylinder (not shown here) via a piston rod 16. Water is thereby removed mechanically from the laundry articles (mechanical drainage). A considerable proportion of the water runs off from the vessel 11 via the counterpressure plate 12 or the water discharge grooves 13.

In the present drainage press, water pressed out of the laundry articles 10 is also discharged on the upper side located opposite the counterpressure plate 12 (upper drainage). For this purpose, the plunger plate 15 is provided with several water throughflow orifices which allow water to be discharge upwards through the plunger plate 15. In the present exemplary embodiment, the water throughflow orifices are formed by pipe connectors 17, of which several, for example five, pipe connectors 17, with a diameter of approximately 12 mm are arranged in the plunger plate 15 at the same peripheral distances from one another, so that a passage for water and air is obtained in the latter. The pipe connectors 17 which are therefore open at the bottom adjoin by means of the upper end a collecting line, in particular an annular channel or tube 18, which extends at a distance above the plunger plate 15 and concentrically relative to this. Connected in turn to the annular channel 18 is an outlet line 19. This is made at least partially elastic (hose), so that it can follow the up-and-down movements of the plunger plate 15. The outlet line 19 is connected, here, to the annular channel 18 via a connection piece 20.

The upper drainage or discharge of water and, if appropriate, air via the plunger plate 15 can be regulated. For this purpose, in the present case, a controllable shutoff valve 21 is located in the region of the connection piece 20. By means of this, the upper drainage system for the upper discharge of water and air can be closed. The shut-off valve 21 is preferably controlled as a function of time (by means of a timer), in such a way that the upper drainage system is effective only during an initial phase of the drainage operation.

A non-return valve 22 is located in the region of each of the pipe connectors 17. These are designed so that flowing media can escape outwards, that is to say in the direction of the annular channel 18, but inflow into the vessel 11 from outside is blocked. The non-return valves 22 are located above the plunger plate, that is to say outside the (closed) vessel 11.

It is advantageous to use the upper drainage system in conjunction with a combined mechanical and flow drainage, such as that described, for example, in DE-A No. 3,228,512. For flow drainage, compressed air is introduced into the vessel 11 via the tubular piston rod 16. A non-return valve 23 in the region of the plunger plate 15 is designed so that compressed air can enter the vessel, but a flow in the opposite direction, that is to say outwards, is shut off. The flow drainage or the feeding of compressed air into the vessel 11 is coordinated in time with the upper drainage, in such a way that compressed air is supplied, with a shut-off valve 21 open, for a limited period of approximately 4 seconds to 10 seconds, especially 5 seconds. As a result, the upper drainage system is briefly blown through with compressed air. The shut-off valve 21 is then closed.

The plunger plate 15 is provided on its underside with an elastic pressure cushion 24. In the exemplary embodyment illustrated, this consists of a slabshaped element, especially of polyurethane foam. A plurality of bores 25 is formed inthe pressure cushion 24, and these allow the throughflow of water or air from the vessel 11 to the pipe connectors 17 and the through flow of compressed air from the compressed-air inlet line in the piston rod 16 of plunger plate 15 to the interior of the vessel 11. lateral channels 26 or the like, openings downwards and extending in a suitable way, are formed on the underside of the plunger plate 15, and these produce flowpaths in the region between the pressure cushion 24 and the plunger plate 15.

The double-sided drainage system, namely upper and lower drainage, is designed so that approximately 40% of the water escapes in the upper region, that is to say via the plunger plate 15, and 60% is discharged at the bottom, that is to say via the counterpressure plate 12.

The upper drainage system also ensures that air inclusions occurring when the laundry articles are flushed into the vessel and when the pressure plunger is lowered into this can escape together with the water.

Figure 2:
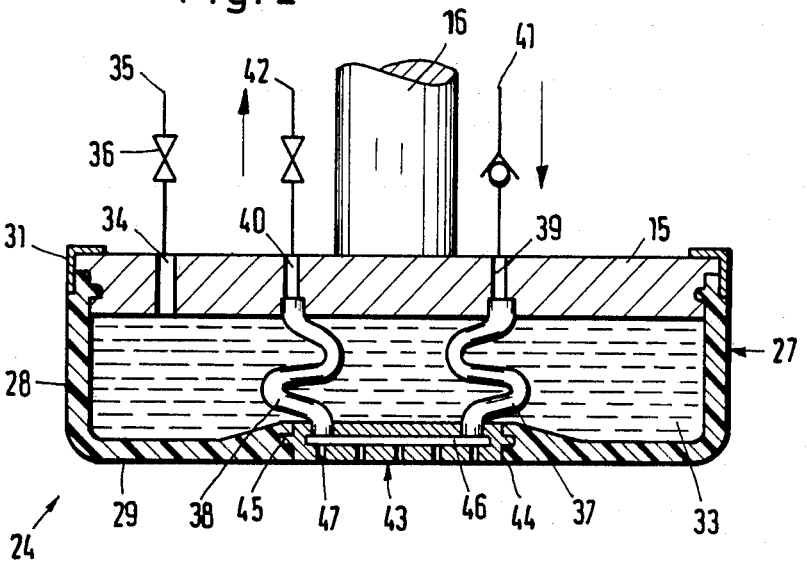
FIG. 2 shows a pressure plunger of another exemplary embodiment of a drainage press, as a detail, likewise in a vertical section.
Figure 3:
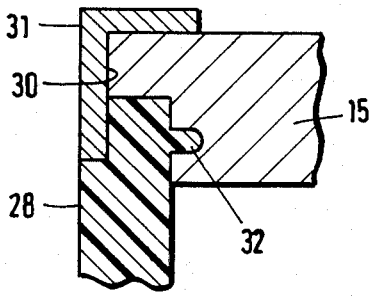
FIG. 3 shows, on an enlarged scale, a detail of the exemplary embodiment of FIG. 2, that is the connection of a diaphragm to a plunger plate.
Figure 4:
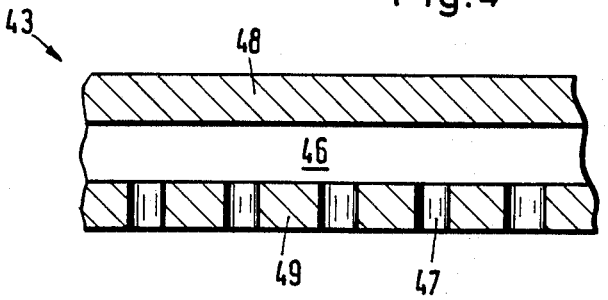
FIG. 4 shows, likewise on an enlarge scale, a further detail of the exemplary embodiment of FIG. 2, that is a cut-out of a distributor plate.

An advantageous alternative design of a plunger plate 15 with a pressure cushion 24 is shown in FIGS. 2 to 4. Here, the pressure cushion is designed as a hollow body 27. An elastic diaphragm made especially of rubber or of plastics similar to rubber is connected all-round to the outer edge of the plunger plate 15, in such a way that an elastic side wall 28 and a likewise elastic bottom wall 29 are formed. The former is connected to a side face 30 of the plunger plate 15, specifically by means of a fastening ring 31 of angular cross-section, which surrounds the top edge of the side wall 28 and which presses against the side face 30. Furthermore, a bead of material 32 of the side wall 28 penetrates into a correspondingly designed groove of the plunger plate 15 FIG. 3.

In the exemplary embodiment of FIG. 2, the hollow body consists of a continuous chamber 33 which here is filled with a liquid, for example water. The liquid (or gas, if appropriate) can be introduced into the chamber under increased pressure, so that the elastic walls of the hollow body 27 are under prestress. The liquid is introduced into the hollow body 27 and, if appropriate, extracted from it via a bore 34 in the plunger plate 15, with a connected filling line 35 and valve 36.

Further lines lead through the plunger plate 15 and through the hollow body 27, in particular at least one air line 37 and one or more water lines 38. The above-mentioned lines 37, 38 are made deformable, especially as hose pieces. In the region of the plunger plate 15, they are connected to associated bores 39, 40. These are connected outside the hollow body 27 to pipe connectors 17 according to the exemplary embodiment of FIG. 1, or to separate air supply lines 41 and water discharge lines 42 respectively.

In the present exemplary embodiment, the (elastic) lines open into a central distributor member which is designed as a distributor plate 43. This is inserted into a recess 44 of the bottom wall 29 of the diaphargm, in particular vulcanised in and also anchored by means of a metal bead 45. The distributor plate 43 preferably consists of bronze, brass or stainless steel.

Within the distributor plate, a shallow slit-like distributor chamber 46 is formed. The lines 37, 38 are connected to this on the inside. On the outside, in particular facing the interior of the vessel 11, there is a plurality of bores 47 which ensures sufficient distribution of the air supplied during flow drainage and which also allows maximum efficiency during drainage via the pressure plunger.

The side wall 28 and bottom wall 29 are preferably made with different wall thicknesses, that is the side wall is made thicker (for example, 20 mm) and the bottom wall 29 thinner (for example, 12 mm). Rubber with a Shore hardness of 55 to 60 is suitable as material.

The distributor plate 43 consisting of the upper wall 48 and lower wall 49 has a total thickness of, for exmaple, 35 mm, the upper wall being 48 to 20 mm thick, the distributor chamber 46 to 10 mm thick and the lower wall 49 only 5 mm thick. The diameter of the distirbutor plate 43 is appropriately 300 mm to 350 mm, with a diameter of the vessel 11 of 850 mm.

Figure 5:
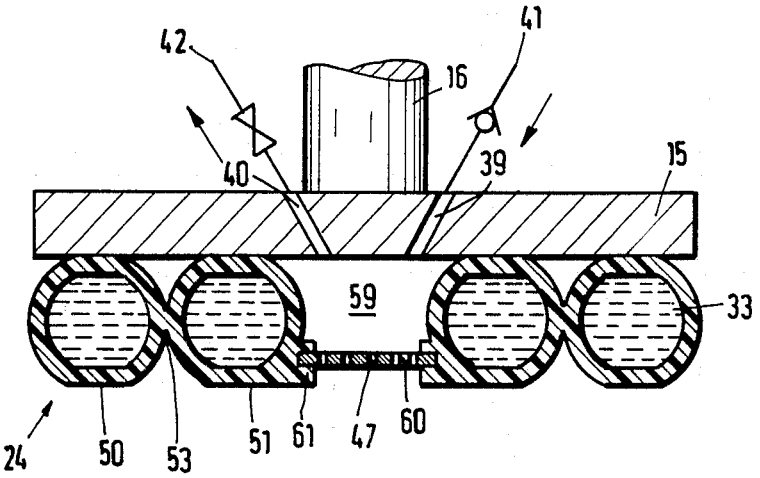
FIG. 5 shows a pressure plunger of a further exemplary embodiment of a drainage press, likewise in a vertical section.
Figure 6:
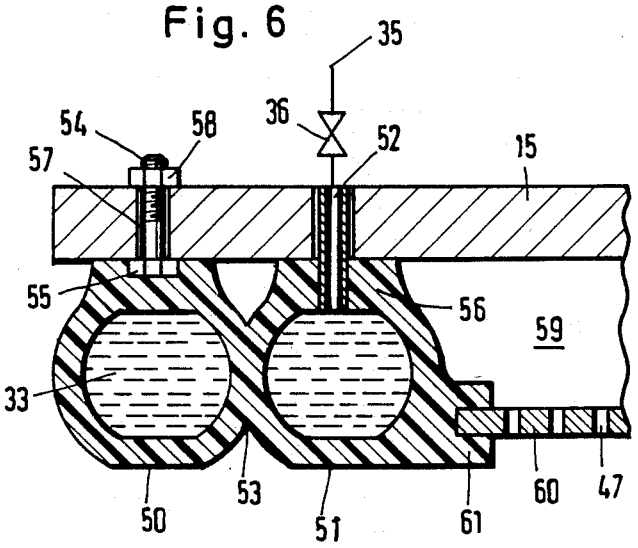
FIG. 6 shows a detail of the exemplary embodiment of FIG. 5 on an enlarged scale.

In the exemplary embodiment of FIGS. 5 and 6, the pressure cushion 24 consists of two annular part chambers 50, 51 arranged concentrically relative to one another. Each of these part chambers 50, 51 forms a self-contained cavity which is filled with liquid (water). For this purpose, each of the part chambers 50, 51 is provided with a water filler connection 52 leading through the plunger plate 15. The hose-like part chambers 50, 51 are connected to one another by means of a web of material 53 and furthermore to the plunger plate 15 by being glued or vulcanised on and/or by means of mechanical implements. In the exemplary embodiments illustrated (FIG. 6), connecting bolts 54 are embedded, that is vulcanised, by means of their bolt head 55 in a thickened portion 56 of the wall of the part chambers 50, 51. The connecting bolts 54 pass through a bore 57 in the plunger plate 15 and are anchored by means of a nut 58.

The annular part chambers 50, 51 limit a central distributor chamber 59 which is limited laterally by the inner part chamber 51, at the top by the plunger plate 15 and at the bottom, that is towards the interior of the vessel 11, by a perforated plate 60. At least one air supply line 41 and at least one water discharge line 42, which perform the function already described, lead to the distributor chamber 59.

The perforated plate 60 is embedded, that is vulcanised and thereby fixed, in an all-round bead-like extension 61 of the inner part chamber 51. The perforated plate 60 is provided with a plurality of bores 47 which allow, on the one hand, a distributed supply of compressed air during flow drainage and, on the other hand, a sufficient discharge of the water via the plunger plate 15.

I claim:

1. An appliance for removing water from washed pieces of laundry comprising:

a cylindrical container for receiving the pieces of laundry, said container including a water-permeable bottom forming a counter-pressure plate, a pressure plunger insertable into the container and moveable up and down with in said container, such that mechanical pressure is exerted on the laundry articles, said pressure plunger including a plunger plate and a pressure cushion mounted beneath the plunger plate at least a portion of said pressure cushion being fluid permeable for draining off of the water upwardly through said pressure cushion as result of mechanical pressure during downward movement of the pressure plunger, and means carried by said plunger plate for drawing off water extruded upwardly through said permeable pressure cushion, flow channel means connecting the top of said permeable pressure cushion with said water drawing off means carried by said plunger plate and means carried by said plunger plate for simultaneously feeding compressed air to said flow channel means upon completion of downward movement of the pressure plunger for flow downwardly through the permeable pressure cushion from said flow channel means.

2. An appliance as claimed in claim 1, wherein said means for drawing off water extruded upwardly through said permeable pressure cushion comprises water through flow orifices within said plunger plate.

3. An appliance as claimed in claim 2, further comprising pipe connectors leading outwardly of said plunger plate, connected to said through flow orifices and at least one elastic outlet line coupled to said pipe connectors remote from said through flow orifices.

4. An appliance as claimed in claim 3, further comprising an annular tube mounted above the plunger plate, and being connected to said pipe connectors, said annular tube being arranged concentrically on said plunger plate, and wherein said at least one outlet line connects to said annular tube.

5. An appliance as claimed in claim 4, further comprising a controllable shut off valve within said at least one outlet line to selectively limit the water extruded upwardly through the permeable pressure cushion to a partial phase of the mechanical dewatering.

6. An appliance as claimed in claim 3, further comprising a non-return valve within each said pipe connector to prevent media flowing into said cylindrical container from the exterior.

7. An appliance as claimed in claim 1, wherein said pressure cushion is elastically deformable.

8. An appliance as claimed in claim 7, wherein said pressure cushion consists of a layer of elastic plastic mounted to the underside of the plunger plate.

9. An appliance as claimed in claim 7, wherein the elastic pressure cushion comprises a hollow body filled with a fluid.

10. An appliance as claimed in claim 7, wherein a rigid, metal distributor plate is vulcanized to the bottom wall of said hollow body and said distributor plate is performatêd to permit air and water to pass therethrough.

11. An appliance as claimed in claim 10, wherein said distributor plate is perforated and said appliance further comprises at least one elastic air line passing through said hollow body and connected to said rigid distributor plate for supplying compressed air through said perforations within said rigid distributor plate to the interior of said cylindrical container receiving the pieces of laundry, beneath said plunger plate.

12. An appliance as claimed in claim 11, wherein said distributor plate includes a shallow interior distributor chamber and a plurality of bores therein on the side facing the cylindrical container water-permeable bottom, and wherein said air line is connected to the interior of said distributor chamber.

13. An appliance as claimed in claim 9, wherein said hollow body is defined by an integral side wall and bottom wall of elastic material, and wherein said hollow body side wall has an edge connected to the periphery of the plunger plate.

14. An appliance as claimed in claim 7, wherein said channel mean comprise channels formed on the underside of the plunger plate which channels open towards the pressure cushion and lead to water through flow orifices within said plunger plate.

15. An appliance as claimed in claim 1, wherein said pressure cushion includes a series of holes therethrough to permit water to pass through the pressure cushion and onto its upper surface for passage through said means for drawing off water carried by said plunger plate.

* * * * *